United States Patent [19]

Kedbrant

[11] Patent Number: 4,817,507

[45] Date of Patent: Apr. 4, 1989

[54] AIR SUPPLY DEVICE

[75] Inventor: Tommy Kedbrant, Guldsmedsvägen 12, S-818 00 Valbo, Sweden

[73] Assignees: Tommy Kedbrant, Valbo; Bo Söderström; Bengt-Ake Gerhartz, both of Gavle, all of Sweden

[21] Appl. No.: 93,545

[22] PCT Filed: Nov. 13, 1986

[86] PCT No.: PCT/SE86/00520

§ 371 Date: Jul. 31, 1987

§ 102(e) Date: Jul. 31, 1987

[87] PCT Pub. No.: WO87/03071

PCT Pub. Date: May 21, 1987

[30] Foreign Application Priority Data

Nov. 13, 1985 [SE] Sweden ..... 8505368

[51] Int. Cl.[4] ..... F24F 13/06

[52] U.S. Cl. ..... 98/40.03

[58] Field of Search ..... 98/40.01, 40.03, 40.04

[56] References Cited

U.S. PATENT DOCUMENTS 2,395,233 2/1946 Richardson ..... 98/40.03

2,742,845 4/1956 Simpson ..... 98/40.04

3,010,380 11/1961 Freeman ..... 48/40.01

3,343,473 9/1967 Gillick et al. ..... 98/40.03 X 4,300,441 11/1981 Dicks ..... 98/40.03

*Primary Examiner*—Harold Joyce

*Attorney, Agent, or Firm*—Oblon, Fisher, Spivak, McClelland & Maier

[57] ABSTRACT

An air supply for a device for conditioning rooms comprises a double-walled air blower (10) which extends along the lower portion of at least one outer wall (2,4,6) of the room, the inner wall (22) of the air blower defining a longitudinal duct (18) adjacent the room wall. This duct communicates with an apparatus for air conditioning and is in its upwardly turned side (22) provided with openings for exhaust of air into the room. The outer wall of the double-walled air blower, which faces the interior of the room, defines a space (20) with the inner wall of the air blower, which space is open towards the room and communicates with the exhaust openings (24). The air blower (10) is designed to form a base in the room at the lower portion of the wall and further designed to produce co-ejection of room air through the space (20) when exhausting air through the exhaust openings. Furthermore, the duct (18) is connected to the apparatus for air conditioning via a pressure box (26) for equalizing the supply pressure, which box is disposed in the wall of the room.

4 Claims, 1 Drawing Sheet

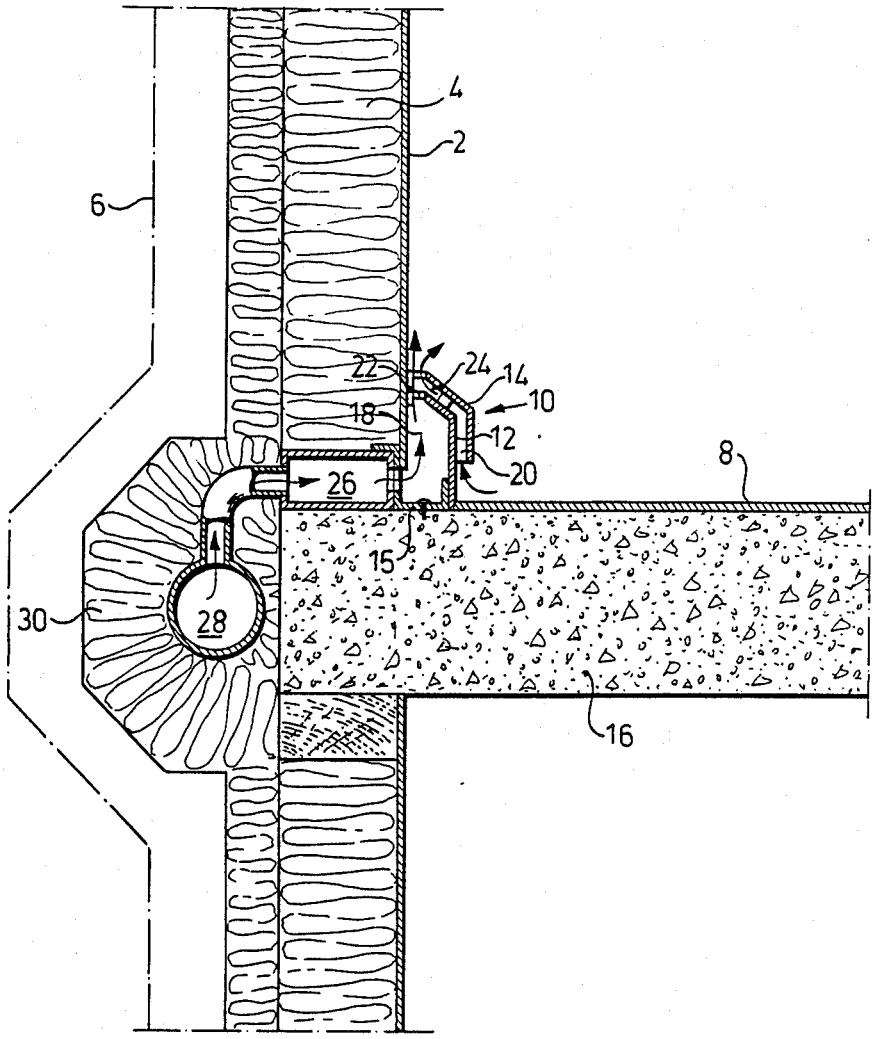
4
2
6
22
24
14
10
18
12
20
8
26
15
30
28
16

AIR SUPPLY DEVICE

BACKGROUND OF THE INVENTION

Field of the Invention

Modern as well as older ventilating systems of our dwellings may not fulfill requirements as to acceptable comfort and function according to declarations from the Swedish authorities. Complaints about bad air, draught problems, moisture and mould have become more and more frequent.

An ordinary manner of solving draught problems is to reduce air circulation or increase the temperature in the flats. In the first instance the air circulation often becomes so low that the resident experiences stale and damp air and at worst gets a mould problem. In the second instance the energy consumption increases in an unacceptable way.

Ventilating systems of modern and older dwellings normally just ventilate the building. The heating is accomplished by means of radiator systems in order to cover the transmission losses.

SUMMARY OF THE INVENTION

In new airtight well insulated houses a very small amount of additional heat from the heating system is needed. The present invention is based on the principle that this amount of additional heat can be supplied to the ventilating air in a ventilating system supplying and removing air.

The device according to the invention is advantageous in that it supplies heat to the ventilating air as well as heat to cover the transmission losses. In this way the radiator system can be dispensed with which lowers the building costs. Thus, the present invention provides improved comfort at the same time as the installation costs are reduced considerably.

The air blower means is preferably located along the whole outer front of the room or flat in order to spread the heated air uniformly and attain a complete degree of ventilation. This location also prevents a possible so-called cold fall from the windows.

The air is blown into the room with such low impulse that dust and similar particles are not carried along by the air stream, which corresponds to an air flow velocity in the range of 0.2–0.8 m/s. The air blown into the room is then preferably forwarded in the flat by means of special upper air means which are located in partition walls about 0.5 m above the floor.

In accordance with an advantageous further development of the device according to the invention said duct is connected to the apparatus for conditioning air by a pressure box mounted in the wall of the room, which box serves to equalize the supply pressure and eliminate turbulence in the air flow.

In accordance with another advantageous embodiment of the device according to the invention the air supply system consists of a ventilating system which by a central apparatus transports ventilating air having a basic temperature, preferably about 15° C., in winter time, to a hot air apparatus in each flat, the temperature of which can be controlled individually, suitably by means of an automatic temperature regulator. In this apparatus the supplied air is preferably mixed with filtered return air in the flat.

The energy is preferably supplied to the hot air apparatus via the circulated hot tap water and/or an electrical battery.

The device according to the invention can suitably be used also in combination with a passive air-solar collector which advantageously forms a portion of the external wall or the roof construction for heating exterior air to the air heating system. When the added solar heat then surmounts what is needed to heat the rooms, it can be used to heat hot tap water. By means of the passive air-solar collector the flats which are adjacent the air-solar collector can be cooled by reverse function of a heat pump. The device according to the invention can also be used for basic ventilation of the room and thus can be generally used for conditioning of rooms.

BRIEF DESCRIPTION OF THE DRAWINGS

An exemplary embodiment of the present invention will now be described more in detail with reference to the annexed drawing which shows a portion of an outer wall of a house adjacent a naked floor, in cross section with a device according to the invention installed.

DETAILED DESCRIPTION OF THE PREFERRED EMBODIMENT

The wall includes an inner limiting board 2, insulation 4 and a front wall covering 6.

Adjacent the inner side 2 of the wall and adjacent the floor 8 a double-walled air blower means 10 is mounted.

The inner wall 12 of the air blower means 10 is fastened to a metal profile 15 which is fastened to the naked floor 16 and the wall 2.

The air blower means 10 extends along the outer wall and against the inner side of the wall of the room and the profile 15 defines a longitudinal duct 18.

At a distance from the inner wall 12 of the air blower means 10 an outer wall 14 is mounted to define a space 20 between the inner and outer walls 12 and 14 respectively of the air blower means 10.

The inner wall 12 as well as the outer wall 14 of the air blower means 10 are provided with suitably dimensioned openings in the upwardly directed portions 22 and 24 respectively. The wall portions 22 and 24 can for example be practically completely open and covered by protective gratings. The openings in the wall portions 22 and 24 are adjusted to the desired upwardly directed air flow.

The duct 18 is connected to a pressure box 26 which is mounted below the room wall and supports it. By means of the box 26 the pressure supply to the duct 18 is equalized and turbulence in the air flow is eliminated. The pressure box in its turn is fed from a supply duct 28 with air from a hot air unit (not shown).

By this design of the supply system with the pressure box 26, the air is blown into the room with such low impulse that dust or other particles are not carried along in the air flow. The flow velocity at the open wall portions 22 and 24, respectively, is in the range of 0.2 to 0.8 m/s. This air, blown through the duct 18, co-ejects room air through the space 20 which is open adjacent the floor 8.

In the design shown in the drawing the supply duct 28 is inserted in an enlargement 30 in the outer wall, on a level with the naked floor 16.

Furthermore, the air blower means 10 is designed to form a base along the outer wall of the room. Hence, the air blower can be mounted along all of the walls of the room.

The device according to the invention can be applied in houses having several flats as well as in small houses.

I claim:

1. An air supply means for a device for conditioning air of rooms, comprising:

a double walled air blower means which extends along at least one outer wall of the room and forms a base inside the room for the lower portion of said room wall, said blower means comprising an inner wall mounted at a distance from an inner side of said wall of the room to delimit, together with said lower portion of the wall of the room and a floor of the room, a longitudinal duct extending along the room wall, an outer wall at a distance from said inner wall of the blower means to define a space between said inner and outer walls separated from said longitudinal duct, and at least one exhaust opening in the upper portion of said inner wall of the blower means and communicating with said space, said space having an inlet at a lower portion thereof and an exhaust opening at an upper portion of said outer wall of the blower means to produce co-ejection of room air through said space when exhausting air from said longitudinal duct through said exhaust openings; and a pressure box for equalizing the pressure and eliminating turbulence in the air flow to said longitudinal duct, said pressure box being mounted below the room wall to support said wall and connected between an air conditioning device and an inlet of said longitudinal duct.

2. A means according to claim 1 wherein said air conditioning device is designed for air exhaust with low impulse such that the air flow velocity from the air blower means is in the range of 0.2 to 0.8 m/s.

3. A means according to claim 2 including a supply duct positioned between said pressure box and the air conditioning device, said supply duct being connected to more than one pressure box.

4. A means according to any one of claims 1, 2 or 3 wherein said air blower means is mounted adjacent the floor and along all the walls of the room.

* * * * *